United States Patent [19]

Kakizaki et al.

[11] Patent Number: 4,707,634

[45] Date of Patent: Nov. 17, 1987

[54] CATHODE RAY TUBE

[75] Inventors: Takehiro Kakizaki; Shoji Araki; Shinichi Numata, all of Kanagawa, Japan

[73] Assignee: Sony Corporation, Tokyo, Japan

[21] Appl. No.: 732,746

[22] Filed: May 10, 1985

[30] Foreign Application Priority Data

May 15, 1984 [JP] Japan ..... 59-96797

[51] Int. Cl.[4] ..... H01J 29/62

[52] U.S. Cl. ..... 313/432; 313/435; 313/479

[58] Field of Search ..... 313/432, 389, 382, 434, 313/435, 436, 439, 450, 479

[56] References Cited

U.S. PATENT DOCUMENTS 2,770,748 11/1956 Schlesinger et al. ..... 313/435

3,286,114 11/1966 Schlesinger ..... 313/450

FOREIGN PATENT DOCUMENTS 54-121662 9/1979 Japan ..... 313/479

*Primary Examiner*—David K. Moore

*Assistant Examiner*—Sandra L. O'Shea

*Attorney, Agent, or Firm*—Hill, Van Santen, Steadman & Simpson

[57] ABSTRACT

A cathode ray tube comprises an envelope, an electron beam source positioned at one end of the envelope, a target positioned at another end of the envelope, a mesh electrode positioned opposite to the target, and an electrostatic lens means positioned between the electron beam source and the mesh electrode. The lens means has a high-tension electrode and a low-tension electrode positioned along the electron beam path to focus the electron beam. The low-tension electrode is divided into four arrow or zig-zag patterns to deflect the electron beam. The length l between the electron beam source and the mesh electrode and the length x of the high-tension electrode are selected to optimize the magnification, aberration and landing error of the electrostatic lens means.

2 Claims, 7 Drawing Figures

CATHODE RAY TUBE

BACKGROUND OF THE INVENTION

1. Field of the Invention

The present invention relates to a cathode ray tube which is preferably applied to an image pickup tube of electrostatic focusing/electrostatic deflection type for example.

2. Description of the Prior Art

The applicant of the present invention has previously proposed an image pickup tube of electrostatic focusing/electrostatic deflection type (S.S type) as shown in FIG. 1 (Japanese Pat. Appln. No. 156167/1983).

In FIG. 1, reference numeral 1 designates a glass bulb, numeral 2 a face plate, numeral 3 a target surface (photoelectric conversion surface), numeral 4 indium for cold sealing, numeral 5 a metal ring, and numeral 6 a signal taking electrode which passes through the face plate 2 and contacts with the target surface 3. A mesh electrode $G_6$ is mounted on a mesh holder 7. Prescribed voltage is applied to the mesh electrode $G_6$ through the metal ring 5, the indium 4 and the mesh holder 7.

Further in FIG. 1, symbols K, $G_1$ and $G_2$ designate a cathode to constitute an electron gun, a first grid electrode and a second grid electrode, respectively. Numeral 8 designates a bead glass to fix these electrodes. Symbol LA designates a beam restricting aperture.

Symbols $G_3$, $G_4$ and $G_5$ designate third, fourth and fifth grid electrodes, respectively. These electrodes $G_3$–$G_5$ are made in process where metal such as chromium or aluminium is evaporated or plated on inner surface of the glass bulb 1 and then prescribed patterns are formed by cutting using a laser, photoectching or the like. These electrodes $G_3$, $G_4$ and $G_5$ constitute the focusing electrode system, and the electrode $G_4$ serves also for deflection.

The electrode $G_5$ is sealed with frit 9 at an end of the glass bulb 1 and is connected to a ceramic ring 11 with a conductive part 10 formed on its surface. The conductive part 10 is formed by sintering silver paste, for example. Prescribed voltage is applied to the electrode $G_6$ through the ceramic ring 11.

The electrodes $G_3$ and $G_4$ are formed as clearly seen in a development of FIG. 2. To simplify the drawing, a part which is not coated with metal is shown by black line in FIG. 2. That is, the electrode $G_4$ is made so-called arrow pattern where four electrode portions $H_+$, $H_-$, $V_+$ and $V_-$, each insulated and zigzaged, are arranged alternately. In this case, each electrode portion is formed to extend in angular range of 270°, for example. Leads (12$H_+$), (12$H_-$), (12$V_+$) and (12$V_-$) from the electrode portions $H_+$, $H_-$, $V_+$ and $V_-$ are formed on the inner surface of the glass bulb 1 simultaneously to the formation of the electrodes $G_3$–$G_5$ in similar manner. The leads (12$H_+$)–(12$V_-$) are isolated from and formed across the electrode $G_3$ and in parallel to the envelope axis. Wide contact parts CT are formed at top end portions of the leads (12$H_+$)–(12$V_-$). In FIG. 2, symbol SL designates a slit which is provided so that the electrode $G_3$ is not heated when the electrode $G_1$ and $G_2$ are heated from outside of the envelope for evacuation. Symbol MA designates a mark for angle in register with the face plate.

In FIG. 1, numeral 13 designates a contactor spring. One end of the contactor spring 13 is connected to a stem pin 14, and other end thereof is contacted with the contact part CT of above-mentioned leads (12$H_+$)–(12$V_-$). The spring 13 and the stem pin 14 are provided for each of the leads (12$H_+$)–(12$V_-$). The electrode portions $H_+$ and $H_-$ to constitute the electrode $G_4$ through the stem pins, the springs and leads (12$H_+$), (12$H_-$), (12$V_+$) and (12$V_-$) are supplied with horizontal deflection voltage varying in symmetry with respect to prescribed voltage. Also the electrode portions $V_+$ and $V_-$ are supplied with vertical deflection voltage varying in symmetry with respect to prescribed voltage.

In FIG. 1, numeral 15 designates another contactor spring. One end of the contactor spring 15 is connected to a stem pin 16, and other end thereof is contacted with above-mentioned electrode $G_3$. Prescribed voltage is applied to the electrode $G_3$ through the stem pin 16 and the spring 15.

Referring to FIG. 3, equipotential surface of electrostatic lenses formed by the electrodes $G_3$–$G_6$ is represented by broken line, and electron beam $B_m$ is focused by such formed electrostatic lenses. The landing error is corrected by the electrostatic lens formed between the electrodes $G_5$ and $G_6$. In FIG. 3, the potential represented by broken line is that excluding the deflection electric field $\vec{E}$.

Deflection of the electron beam $B_m$ is effected by the deflection electric field $\vec{E}$ according to the electrode $G_4$.

In FIG. 1, the ceramic ring 11 with the conductive part 10 formed on its surface is sealed with the frit 9 at one end of the glass bulb 1 in order to apply the prescribed voltage to the electrode $G_5$. Since the machining process for the frit seal of the ceramic ring 11 is required, the manufacturing becomes difficult.

Further in FIG. 1, potential of the electrode $G_5$ must be high and the potential difference between the electrodes $G_4$ and $G_5$ must be large in order to improve the focusing characteristics of the electron beam on the target surface 3. Since the collimation lens is formed between the electrode $G_5$ and the mesh electrode $G_6$ and the landing error of the electron beam is corrected, potential difference of some degree is required between the electrodes $G_5$ and $G_6$. Under consideration of above aspects, a cathode ray tube in the prior art is operated in such conditions that voltage $E_{G3}$ of the electrode $G_3$=500 V, center voltage $E_{G4}$ of the electrode $G_4$=0 V, voltage $E_{G5}$ of the electrode $G_5$=500 V, voltage $E_{G6}$ of the electrode $G_6$=1160 V, and voltage $E_{TA}$ of the target surface 3=50 V. Since the voltage $E_{G6}$ of the mesh electrode $G_6$ becomes considerably high in this constitution, discharge may be produced between the electrode $G_6$ and the target 3 so as to flaw the target surface 3.

SUMMARY OF THE INVENTION

In view of such disadvantages in the prior art, an object of the invention is to provide a cathode ray tube in which the manufacturing is simplified and voltage of the mesh electrode may be low.

In order to attain the above object, a cathode ray tube of the invention comprises a high-voltage electrode of cylindrical form, a low-voltage electrode of cylindrical form and a mesh electrode, all arranged along the electron beam path, wherein the electrostatic lens for focusing is formed by the high-voltage electrode and the low-voltage electrode, and the low-voltage electrode acts as a deflection electrode.

Since the invention is constituted in such manner and there is no electrode $G_5$ as in FIG. 1, the manufacturing is simplified and voltage of the mesh electrode may be low and therefore problem of discharge is eliminated.

DESCRIPTION OF THE PREFERRED EMBODIMENT

Figure 1:
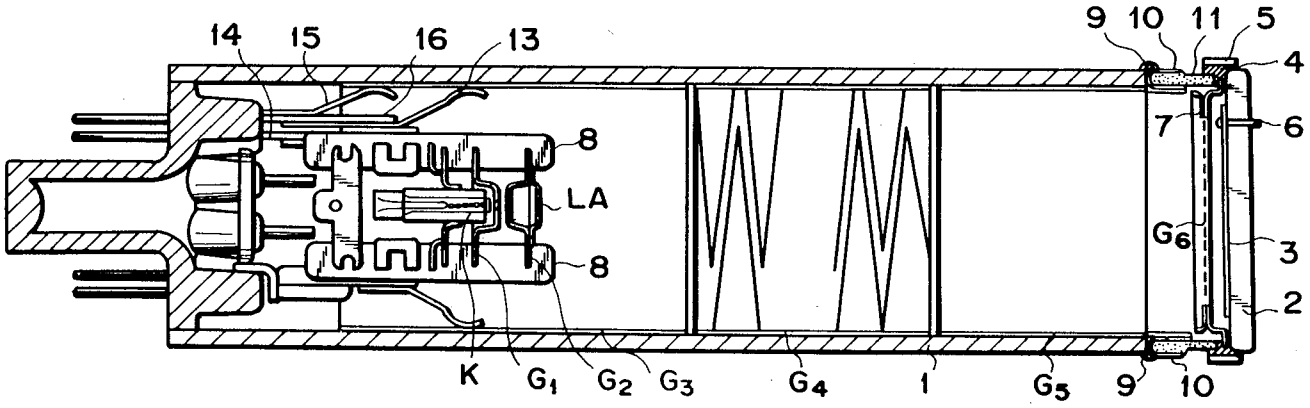
FIG. 1 PRIOR ART
FIG. 1 is a sectional view of an example of an image pickup tube in the prior art.
Figure 4:
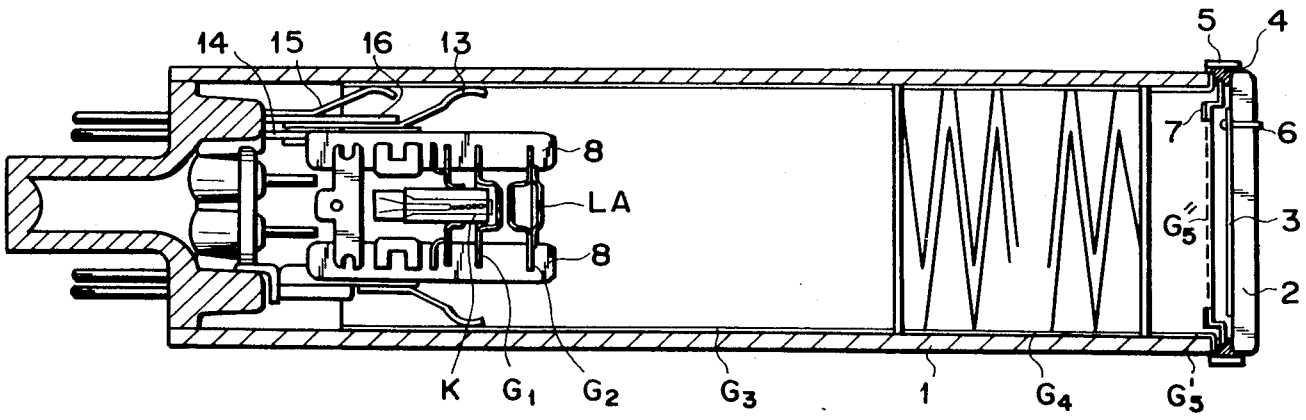
FIG. 4 is a sectional view of an image pickup tube as an embodiment of the invention.

An embodiment of the invention will now be described referring to FIG. 4. In FIG. 4, parts corresponding to FIG. 1 are designated by the same reference numerals and the detailed description shall be omitted.

In FIG. 4, indium 4 fixed in a metal ring 5 is grasped between a face plate 2 and a glass bulb 1, and the face plate 2 and the glass bulb are sealed in air tightness by the indium 4. A mesh electrode $G''_5$ is mounted on a mesh holder 7. Prescribed voltage is applied to the electrode $G''_5$ through the metal ring 5, the indium 4 and the mesh holder 7.

Symbols $G_3$ and $G_4$ designate third and fourth grid electrodes, respectively. These electrodes $G_3$ and $G_4$ constitute the focusing electrode system, and the electrode $G_4$ serves also for deflection. An electrode $G'_5$ is electrically connected to the mesh electrode $G''_5$. These electrodes $G_3$, $G_4$ and $G'_5$ are made in process that metal such as chromium or aluminium is evaporated on inner surface of the glass bulb 1 and then prescribed patterns are formed by cutting using a laser, photoetching or the like.

Figure 2:
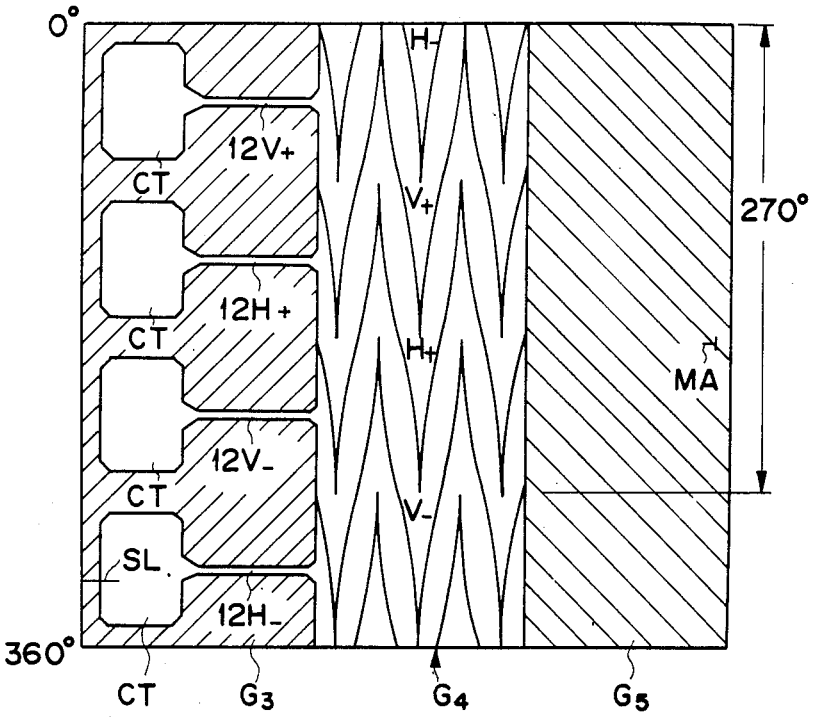
FIG. 2 PRIOR ART
FIG. 2 is a development of essential part in FIG. 1.
Figure 3:
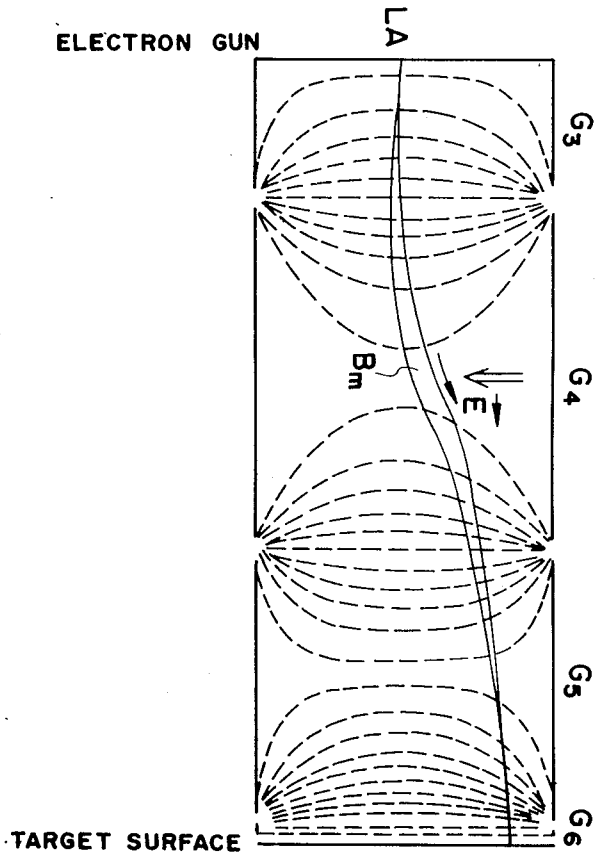
FIG. 3 PRIOR ART
FIG. 3 is a diagram illustrating potential distribution in FIG. 1.
Figure 5:
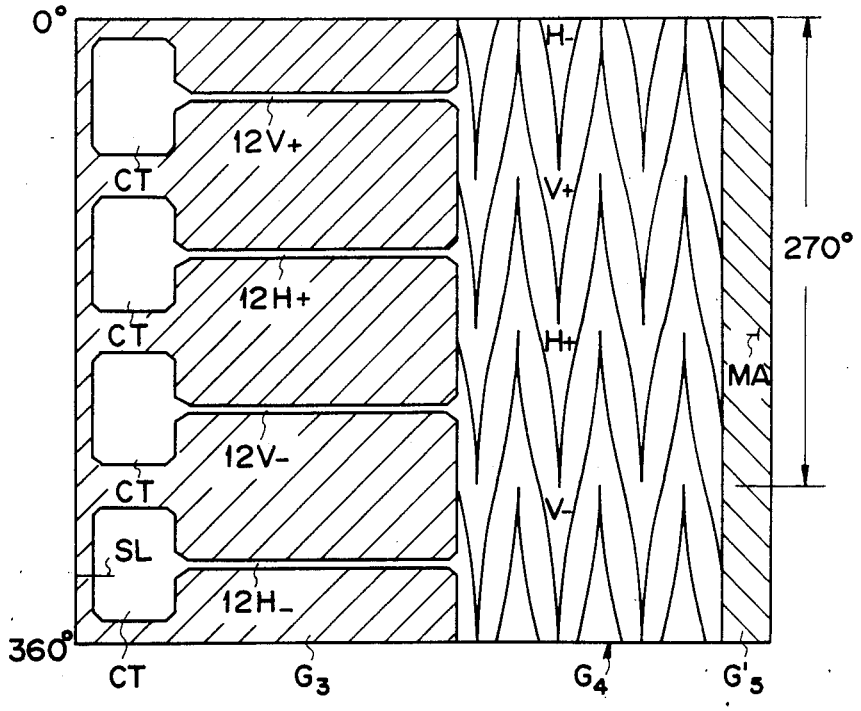
FIG. 5 is a development of essential part in FIG. 4.

These electrodes $G_3$, $G_4$ and $G'_5$ are formed as clearly seen in a development of FIG. 5. In FIG. 5, parts corresponding to FIG. 2 are designated by the same symbols. In FIG. 5, too, the electrode $G_4$ is made so-called arrow pattern where four electrode portions $H_+$, $H_-$, $V_+$ and $V_-$, each insulated and zigzaged, are arranged alternately. Leads (12$H_+$), (12$H_-$), (12$V_+$) and (12$V_-$) from the electrode portions $H_+$, $H_-$, $V_+$ and $V_-$ are isolated from and formed across the electrode $G_3$ and in parallel to the envelope axis. Wide contact parts CT are formed at top end portions of the leads (12$H_+$)-(12$V_-$).

Voltage is applied to the electrodes $G_3$ and $G_4$ in similar manner to FIG. 1.

Figure 6:
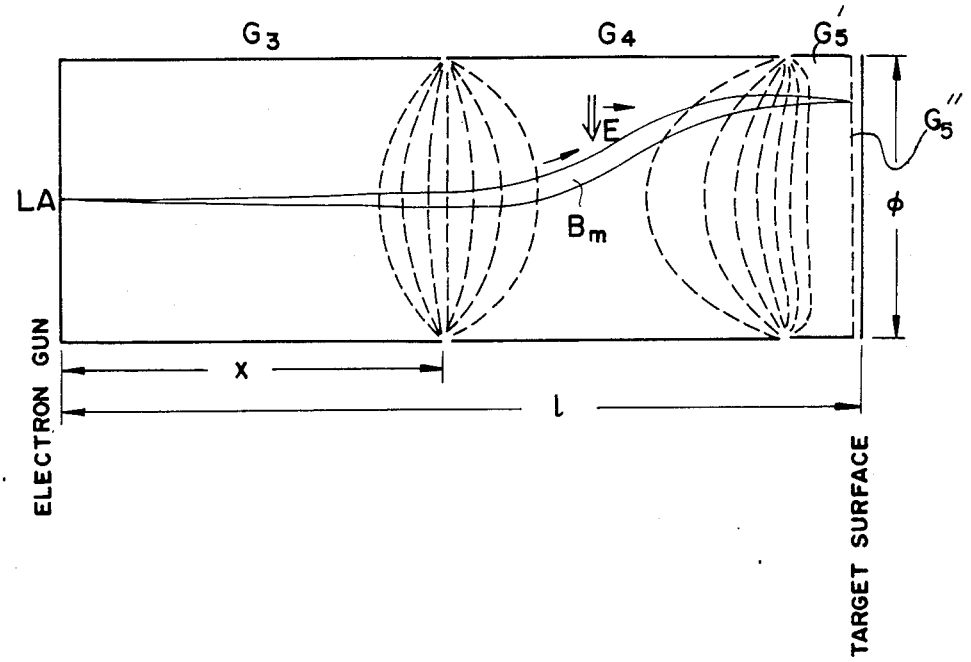
FIG. 6 is a diagram illustrating potential distribution in FIG. 4.

Referring to FIG. 6, equipotential surface of electrostatic lenses formed by the electrodes $G_3$-$G''_5$ ($G'_5$) is represented by broken line. The electron beam $B_m$ is focused by the electrostatic lens formed between the electrodes $G_3$ and $G_4$, and the landing error which is much shorter than electrode $G_5$ of the prior art is corrected by the electrostatic lens formed between the electrodes $G_4$ and $G'_5$. In FIG. 6, the potential represented by broken line is that excluding the deflection electric field $\vec{E}$.

In the embodiment where the focusing electrode system is formed by the electrodes $G_3$ and $G_4$, variation of length x of the electrode $G_3$ (length from the beam restricting aperture LA to the electrode $G_4$) and tube length l (distance from the beam restricting aperture LA to the target surface 3) as shown in FIG. 6 causes variation of the projection magnification, the aberration and the landing error. In FIG. 6, symbol $\phi$ designates a tube diameter.

Figure 7:
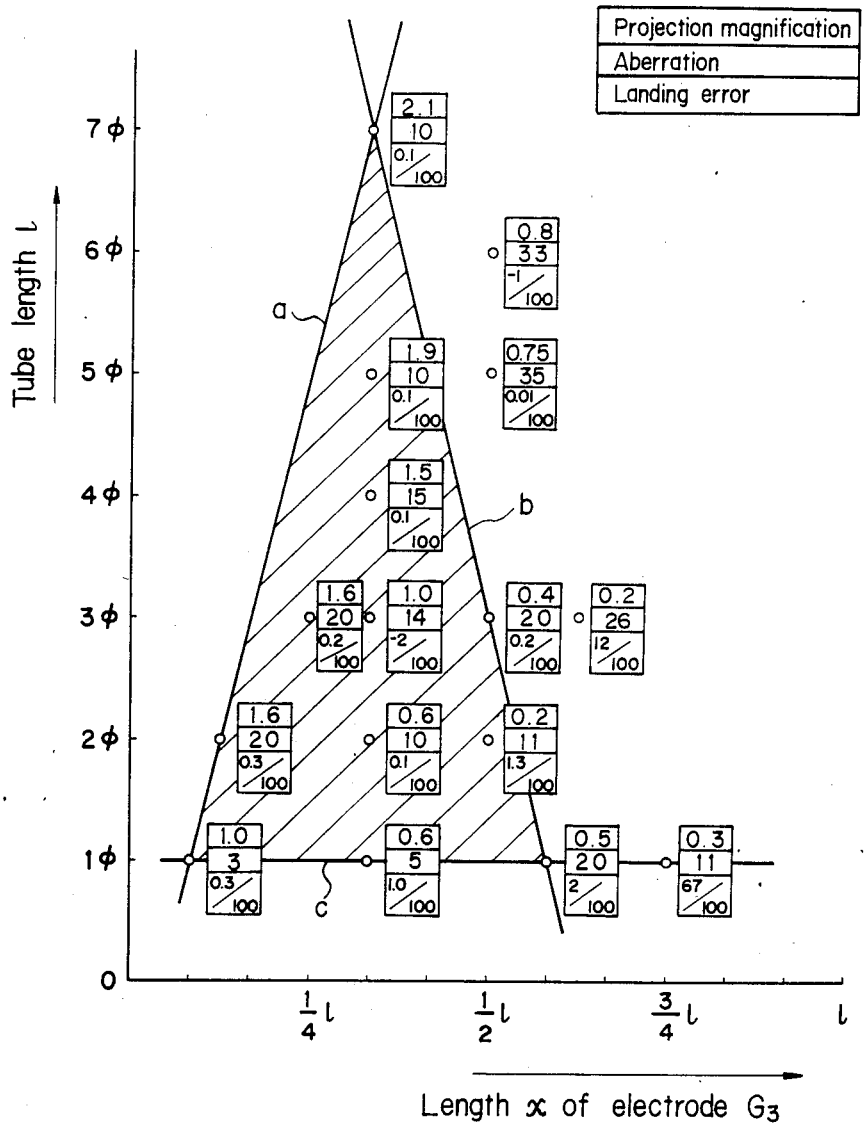
FIG. 7 is a diagram illustrating simulation results in the embodiment.

FIG. 7 shows simulation results of the projection magnification, the aberration ($\mu$m) and the landing error (rad) with respect to prescribed value of x and l in an envelope of $\frac{1}{2}$ inches ($\phi = 12$ mm) for example, where voltage $E_{G3}$ of the electrode $G_3$ is 500 V, center voltage $E_{G4}$ of the electrode $G_4$ is voltage to optimized the focusing at $E_{G4} < E_{G3}$ voltage $E_{G5}$ of the mesh electrode $G''_5$ is voltage to realize the best characteristics, divergence angle is 1/50 (small in high $E_{G3}$), and in range of $1/12\ l \leqq x \leqq \frac{3}{4}\ l$, $1\phi \leqq l \leqq 7\phi$. The aberration and the landing error are taken when the deflection distance from the center is 3.3 mm.

It is preferable for the good use as an image pickup tube that the projection magnification is two or less, the aberration is 20 $\mu$m or less, and the landing error is 2/100 radian or less. Consequently, in FIG. 7, line a is determined from restriction of the projection magnification, line b is determined from restriction of the aberration, and line c is determined from restriction of the landing error. It is therefore preferable that x and l are set to hatched part enclosed by lines a–c in FIG. 7. Although FIG. 7 shows simulation results in an envelope of $\frac{1}{2}$ inches, above-mentioned range of x and l may be applied to other size.

In the embodiment of FIG. 4 under consideration of above aspects, length x of the electrode $G_3$ and the tube length l are set to hatched part in FIG. 7 for example and the good characteristics can be obtained.

Since the embodiment is constituted as above described and made so-called bipotential type where the electron beam $B_m$ is focused by the electrodes $G_3$ and $G_4$, there is no electrode $G_5$ as in FIG. 1. It is noted that electrode $G'_5$ is much shorter than electrode $G_5$ of FIG. 1. Consequently, machining such as installation of a ceramic 11 for applying prescribed voltage to the electrode $G_5$ in FIG. 1 becomes unnecessary, and the manufacturing becomes easy.

In FIG. 1, voltage $E_{G5}$ of the electrode $G_5$ is relatively high and therefore voltage $E_{G6}$ of the mesh electrode $G_6$ is made considerably high for formation of the collimation lens. However, in the embodiment, since there exists no electrode $G_5$ in FIG. 1 and voltage $E_{G4}$ of the electrode $G_4$ becomes considerably low, voltage $E_{G5}$ of the mesh electrode $G''_5$ may be made low. Accordingly, in the embodiment, since the voltage $E_{G5}$ of the mesh electrode $G''_5$ may be made low, problem of discharge between the mesh electrode $G''_5$ and the target surface 3 is eliminated.

Furthermore, since region of the electrode $G_4$ can be lengthened in the embodiment, the deflection sensitivity can be increased in comparison to the prior art.

Although the embodiment relates to application of the invention to an image pickup tube of electrostatic focusing/electrostatic deflection type, the invention can be applied not only to this type but also to cathode ray tubes such as a storage tube or a scan converter.

According to the invention as clearly seen in the above embodiment, the process number becomes small and the manufacturing becomes easy in comparison to the prior art, and voltage of the mesh electrode may be made low and problem of discharge is eliminated. Moreover, the deflection region can be lengthened and the deflection sensitivity can be improved in comparison to the prior art.

What is claimed is:

1. A cathode ray tube comprising:

(a) an envelope;

(b) an electron beam source positioned at one end of said envelope;

(c) a target positioned at another end of said envelope opposite to said electron beam source;

(d) a mesh electrode positioned opposite to said target; and (e) an electrostatic lens means positioned between said electron beam source and said mesh electrode and including a cylindrical focussing electrode $G'_5$, said means having a high-voltage electrode and a neighboring low-voltage electrode respectively positioned along said electron beam path to focus said electron beam, said low-voltage electrode being divided into four arrow or zig-zag patterns to deflect said electron beam and wherein one of the cylindrical focussing electrodes $G'_5$ has been substantially shortened.

2. A cathode ray tube comprising:

(a) an envelope;

(b) an electron beam source positioned at one end of said envelope;

(c) a target positioned at another end of said envelope opposite to said electron beam source;

(d) a mesh electrode positioned opposite to said target;

(e) an electrostatic lens means positioned between said electron beam source and said mesh electrode, said means having a high-voltage electrode and a low-voltage electrode respectively positioned along said electron beam path to focus said electron beam, said low-voltage electrode being divided into four arrow or zig-zag patterns to deflect said electron beam; and (f) wherein the length l between said electron beam source and said mesh electrode, and the length x of said high-voltage electrode are selected such that magnification, aberration, and landing error of said electrostatic lens means are respectively smaller than 2, 20 $\mu$m, and $\pm 2/100$ radian.

* * * * *